US007959517B2

(12) United States Patent
Lastowka

(10) Patent No.: US 7,959,517 B2
(45) Date of Patent: Jun. 14, 2011

(54) INFRARED SENSING LAUNCH MONITOR

(75) Inventor: Eric J. Lastowka, Hanover, MA (US)

(73) Assignee: Acushnet Company, Fairhaven, MA (US)

( * ) Notice: Subject to any disclaimer, the term of this patent is extended or adjusted under 35 U.S.C. 154(b) by 1094 days.

(21) Appl. No.: 10/929,400

(22) Filed: Aug. 31, 2004

(65) Prior Publication Data

US 2006/0046861 A1 Mar. 2, 2006

(51) Int. Cl.

| | |
|---|---|
| ***A63B 57/00*** | (2006.01) |
| ***A63B 67/02*** | (2006.01) |
| ***G01J 5/00*** | (2006.01) |
| ***G01T 1/29*** | (2006.01) |
| ***H01J 31/49*** | (2006.01) |

(52) U.S. Cl. ..... 473/198; 473/151; 473/152; 473/155; 473/156; 473/378; 374/130; 250/493.1; 250/370.1; 250/333

(58) Field of Classification Search ..... 374/43, 374/130, 132; 62/6, 51.1; 250/493.1, 443.1, 250/442.1, 370.1, 370, 353, 252, 338.4, 334, 250/333, 332, 330, 306, 238, 467, 442.11, 250/370.01, 370.02, 370.03, 370.04, 370.05, 250/370.06, 370.07, 370.08, 370.09, 467.1, 250/467.2; 473/198–200, 141, 139, 150–152, 473/155, 156, 378

See application file for complete search history.

(56) References Cited

U.S. PATENT DOCUMENTS

| | | | |
|---|---|---|---|
| 1,876,657 | A | 5/1932 | Fox |
| 2,472,893 | A | 6/1949 | Lyle |
| 2,610,504 | A | 4/1952 | Nigh |
| 2,660,880 | A | 12/1953 | Vivian |
| 2,755,658 | A | 7/1956 | Brown |
| 2,783,999 | A | 3/1957 | Simjian |
| 2,825,569 | A | 3/1958 | Alvarez |
| 2,933,681 | A | 4/1960 | Crain |
| 3,016,812 | A | 1/1962 | Chatlain |
| 3,091,466 | A | 5/1963 | Speiser |
| 3,160,011 | A | 12/1964 | Ogden |
| 3,173,348 | A | 3/1965 | Betinis |

(Continued)

FOREIGN PATENT DOCUMENTS

JP 09-083165 A * 3/1997

OTHER PUBLICATIONS

Machine translation of JP 09-083165 A, application JP 07-223558, downloaded from http://dossier1.ipdl.inpit.go.jp, Jul. 2, 2010.*

(Continued)

*Primary Examiner* — David L Lewis

*Assistant Examiner* — Matthew D. Hoel

(74) *Attorney, Agent, or Firm* — Murphy King, P.C.

(57) ABSTRACT

A method and apparatus for changing the temperature pattern of the surface of a golf ball or golf club is disclosed. The apparatus includes a thermal device capable of imparting a temperature pattern onto the surface of a golf ball. The thermal device preferably imparts the temperature pattern from a distance, preferably while the golf ball is positioned on a golf tee. After a predetermined amount of time, the golf ball may be stuck by a golf club. A thermal imaging device, which may detect a cooling pattern imparted to the golf ball by prongs of a cooling device, is preferably used to acquire images of the temperature pattern. The acquired images may then be analyzed by a processor to determine the kinematic characteristics of the golf ball.

22 Claims, 3 Drawing Sheets

U.S. PATENT DOCUMENTS

| | | | | | |
|---|---|---|---|---|---|
| 3,182,508 | A | | 5/1965 | Varju | |
| 3,270,564 | A | | 9/1966 | Evans | |
| 3,353,282 | A | | 11/1967 | Sneed | |
| 3,359,005 | A | | 12/1967 | Cameron | |
| 3,364,751 | A | | 1/1968 | Cornell et al. | |
| 3,408,750 | A | | 11/1968 | McCollough et al. | |
| 3,429,571 | A | | 2/1969 | Abel, Jr. | |
| 3,469,905 | A | | 9/1969 | Baldwin et al. | |
| 3,508,440 | A | | 4/1970 | Murphy | |
| 3,513,707 | A | | 5/1970 | Russell | |
| 3,566,668 | A | | 3/1971 | Browning | |
| 3,589,732 | A | | 6/1971 | Russell et al. | |
| 3,598,976 | A | | 8/1971 | Russell | |
| 3,630,601 | A | | 12/1971 | Lehovec | |
| 3,633,007 | A | | 1/1972 | Sanders | |
| 3,633,008 | A | | 1/1972 | Sanders | |
| 3,671,724 | A | | 6/1972 | Sanders | |
| 3,717,857 | A | | 2/1973 | Arciprete et al. | |
| 3,759,528 | A | | 9/1973 | Christophers | |
| 3,788,647 | A | | 1/1974 | Evans | |
| 3,792,863 | A | | 2/1974 | Evans | |
| 3,793,481 | A | | 2/1974 | Ripley et al. | |
| 3,804,518 | A | | 4/1974 | Meyr | |
| 3,806,131 | A | | 4/1974 | Evans | |
| 3,818,341 | A | | 6/1974 | Burdick | |
| 3,820,133 | A | | 6/1974 | Adorney et al. | |
| 3,909,521 | A | * | 9/1975 | Hunt et al. | 348/167 |
| 3,918,073 | A | | 11/1975 | Henderson et al. | |
| 3,935,669 | A | | 2/1976 | Potrzuski et al. | |
| 3,945,646 | A | | 3/1976 | Hammond | |
| 3,992,012 | A | | 11/1976 | Campbell | |
| 3,999,403 | A | * | 12/1976 | Bower et al. | 62/51.2 |
| 4,005,261 | A | | 1/1977 | Sato et al. | |
| 4,025,718 | A | | 5/1977 | Paretti | |
| 4,033,318 | A | | 7/1977 | O'Grady | |
| 4,041,293 | A | | 8/1977 | Kihlberg | |
| 4,063,259 | A | | 12/1977 | Lynch et al. | |
| 4,088,324 | A | | 5/1978 | Farmer | |
| 4,136,387 | A | | 1/1979 | Dabroski | |
| 4,137,566 | A | | 1/1979 | Haas et al. | |
| 4,138,118 | A | | 2/1979 | Budney | |
| 4,147,040 | A | * | 4/1979 | Altman | 62/467 |
| 4,148,096 | A | | 4/1979 | Haas et al. | |
| 4,150,552 | A | * | 4/1979 | Altman | 62/467 |
| 4,155,226 | A | * | 5/1979 | Altman | 62/467 |
| 4,155,555 | A | | 5/1979 | Fink | |
| 4,158,853 | A | | 6/1979 | Sullivan et al. | |
| 4,160,942 | A | | 7/1979 | Lynch et al. | |
| 4,223,891 | A | | 9/1980 | Van Gaasbeek et al. | |
| 4,239,227 | A | | 12/1980 | Davis | |
| 4,306,722 | A | | 12/1981 | Rusnak | |
| 4,306,723 | A | | 12/1981 | Rusnak | |
| 4,327,918 | A | | 5/1982 | Foster | |
| 4,342,054 | A | | 7/1982 | Terui et al. | |
| 4,360,199 | A | | 11/1982 | Jackson | |
| 4,375,887 | A | | 3/1983 | Lynch et al. | |
| 4,461,477 | A | | 7/1984 | Stewart | |
| 4,477,079 | A | | 10/1984 | White | |
| 4,570,607 | A | | 2/1986 | Stokes | |
| 4,580,786 | A | | 4/1986 | Shipley | |
| 4,630,829 | A | | 12/1986 | White | |
| 4,640,120 | A | | 2/1987 | Garritano et al. | |
| 4,684,133 | A | | 8/1987 | Maroth | |
| 4,695,888 | A | | 9/1987 | Peterson | |
| 4,695,891 | A | | 9/1987 | Peterson | |
| 4,711,754 | A | | 12/1987 | Bednar | |
| 4,713,686 | A | | 12/1987 | Ozaki et al. | |
| 4,759,219 | A | | 7/1988 | Cobb et al. | |
| 4,767,121 | A | | 8/1988 | Tonner | 473/141 |
| 4,822,042 | A | | 4/1989 | Landsman | |
| 4,830,377 | A | | 5/1989 | Kobayashi | |
| 4,834,376 | A | | 5/1989 | Steinberg | |
| 4,844,469 | A | | 7/1989 | Yasuda et al. | |
| 4,858,934 | A | | 8/1989 | Ladick et al. | |
| 4,861,034 | A | | 8/1989 | Lee | |
| 4,870,868 | A | | 10/1989 | Gastgeb et al. | |
| 4,873,843 | A | * | 10/1989 | Volten | 62/51.1 |
| 4,893,182 | A | | 1/1990 | Gautraud et al. | |
| 4,898,388 | A | | 2/1990 | Beard, III et al. | |
| 4,898,389 | A | | 2/1990 | Plutt | |
| 4,917,490 | A | * | 4/1990 | Schaffer et al. | 356/152.1 |
| 4,930,787 | A | | 6/1990 | Nobles, Jr. | |
| 4,940,236 | A | | 7/1990 | Allen | |
| 4,955,204 | A | * | 9/1990 | Pehl et al. | 62/51.1 |
| 4,958,836 | A | | 9/1990 | Onozuka et al. | 473/141 |
| 4,967,596 | A | | 11/1990 | Rilling et al. | |
| 4,991,850 | A | | 2/1991 | Wilhlem | |
| 4,991,851 | A | | 2/1991 | Melesio | |
| 5,031,909 | A | | 7/1991 | Pecker | |
| 5,054,785 | A | | 10/1991 | Gobush et al. | |
| 5,056,791 | A | | 10/1991 | Poillon et al. | |
| 5,082,283 | A | | 1/1992 | Conley et al. | |
| 5,101,268 | A | | 3/1992 | Ohba | |
| 5,111,410 | A | | 5/1992 | Nakayama et al. | |
| 5,118,102 | A | | 6/1992 | Bahill et al. | |
| 5,131,660 | A | | 7/1992 | Marocco | |
| 5,179,441 | A | | 1/1993 | Anderson et al. | |
| 5,184,826 | A | | 2/1993 | Hall, Jr. | |
| 5,209,483 | A | | 5/1993 | Gedney et al. | |
| 5,210,602 | A | | 5/1993 | Mintzer | |
| 5,221,082 | A | | 6/1993 | Curshod | 473/199 |
| 5,221,088 | A | | 6/1993 | McTeigue et al. | |
| 5,226,660 | A | | 7/1993 | Curchod | |
| 5,228,697 | A | | 7/1993 | Gulick et al. | |
| 5,233,544 | A | | 8/1993 | Kobayashi | |
| 5,246,232 | A | | 9/1993 | Eccher et al. | |
| 5,247,835 | A | | 9/1993 | Howell | |
| 5,259,617 | A | | 11/1993 | Soong | |
| 5,269,177 | A | | 12/1993 | Miggins et al. | |
| 5,297,796 | A | | 3/1994 | Peterson | |
| 5,303,925 | A | | 4/1994 | Rawson | |
| 5,309,753 | A | | 5/1994 | Johnson | |
| 5,322,289 | A | | 6/1994 | Abrams et al. | |
| 5,332,225 | A | | 7/1994 | Ura | |
| 5,342,051 | A | | 8/1994 | Rankin et al. | |
| 5,342,054 | A | | 8/1994 | Chang et al. | |
| 5,365,402 | A | * | 11/1994 | Hatada et al. | 361/699 |
| 5,375,844 | A | | 12/1994 | Waud | |
| 5,377,541 | A | | 1/1995 | Patten | |
| 5,395,116 | A | | 3/1995 | Blaakman | |
| 5,413,345 | A | | 5/1995 | Nauck | 473/156 |
| 5,419,563 | A | | 5/1995 | Abrams et al. | |
| 5,435,561 | A | | 7/1995 | Conley | |
| 5,437,457 | A | | 8/1995 | Curchod | |
| 5,441,256 | A | | 8/1995 | Hackman | |
| 5,441,269 | A | | 8/1995 | Henwood | |
| 5,447,311 | A | | 9/1995 | Viollaz et al. | |
| 5,464,208 | A | | 11/1995 | Pierce | 473/451 |
| 5,469,627 | A | | 11/1995 | Denny et al. | |
| 5,471,383 | A | | 11/1995 | Gobush et al. | |
| 5,472,205 | A | | 12/1995 | Bouton | |
| 5,474,298 | A | | 12/1995 | Lindsay | |
| 5,482,283 | A | | 1/1996 | Wall | |
| 5,486,001 | A | | 1/1996 | Baker | 473/266 |
| 5,486,002 | A | | 1/1996 | Witler et al. | |
| 5,489,099 | A | | 2/1996 | Rankin et al. | 473/199 |
| 5,492,329 | A | | 2/1996 | Kronin | |
| 5,501,463 | A | | 3/1996 | Gobush et al. | |
| 5,507,485 | A | | 4/1996 | Fisher | 473/407 |
| 5,575,719 | A | | 11/1996 | Gobush et al. | |
| 5,582,552 | A | | 12/1996 | Hofmeister | |
| 5,586,940 | A | | 12/1996 | Dosch et al. | |
| 5,589,628 | A | | 12/1996 | Braly | |
| 5,609,534 | A | | 3/1997 | Gebhardt et al. | |
| 5,616,832 | A | | 4/1997 | Nauck | |
| 5,623,459 | A | | 4/1997 | Iwamura et al. | |
| 5,625,577 | A | | 4/1997 | Kunii et al. | |
| 5,634,855 | A | | 6/1997 | King | |
| 5,638,300 | A | | 6/1997 | Johnson | |
| 5,645,494 | A | | 7/1997 | Dionne et al. | 473/278 |
| 5,672,809 | A | | 9/1997 | Brandt | |
| 5,682,230 | A | | 10/1997 | Anfinsen et al. | |
| 5,682,331 | A | * | 10/1997 | Berlin | 702/150 |
| 5,688,183 | A | | 11/1997 | Sabatino et al. | |
| 5,691,921 | A | * | 11/1997 | Berlin | 702/99 |
| 5,694,340 | A | | 12/1997 | Kim | |
| 5,697,791 | A | | 12/1997 | Nashner et al. | |

| | | | | |
|---|---|---|---|---|
| 5,700,204 | A | 12/1997 | Teder | 473/199 |
| 5,707,298 | A | 1/1998 | Chovanes | |
| 5,709,610 | A | 1/1998 | Ognjanovic | |
| 5,779,241 | A | 7/1998 | D'Costa et al. | |
| 5,779,555 | A | 7/1998 | Nomura et al. | |
| 5,792,000 | A | 8/1998 | Weber et al. | |
| 5,792,001 | A | 8/1998 | Henwood | |
| 5,798,519 | A * | 8/1998 | Vock et al. | 250/206.1 |
| 5,803,823 | A | 9/1998 | Gobush | |
| 5,803,826 | A | 9/1998 | Perrine | |
| 5,823,786 | A | 10/1998 | Easterbrook | 434/247 |
| 5,863,255 | A | 1/1999 | Mack | |
| 5,879,246 | A | 3/1999 | Gebhardt et al. | |
| 5,899,822 | A | 5/1999 | Yamgishi et al. | |
| 5,904,484 | A | 5/1999 | Burns | 434/252 |
| 5,906,547 | A | 5/1999 | Tynan | 473/199 |
| 5,916,040 | A | 6/1999 | Umazume | |
| 5,989,135 | A | 11/1999 | Welch | |
| 6,034,723 | A | 3/2000 | Fujimori | |
| 6,042,483 | A | 3/2000 | Katayama | |
| 6,042,492 | A | 3/2000 | Baum | |
| 6,079,612 | A | 6/2000 | Tung | |
| 6,185,850 | B1 | 2/2001 | Erkel | |
| 6,186,002 | B1 | 2/2001 | Lieberman et al. | |
| 6,186,910 | B1 | 2/2001 | Kobayashi | |
| 6,195,090 | B1 | 2/2001 | Riggins, III | |
| 6,213,888 | B1 | 4/2001 | Kawaguchi et al. | |
| 6,224,499 | B1 | 5/2001 | Ogg | |
| 6,231,453 | B1 | 5/2001 | Jebe | |
| 6,241,622 | B1 | 6/2001 | Gobush et al. | |
| 6,286,364 | B1 | 9/2001 | Aoyama et al. | |
| 6,292,130 | B1 | 9/2001 | Cavallaro et al. | |
| 6,293,802 | B1 | 9/2001 | Ahlgren | |
| 6,320,173 | B1 | 11/2001 | Vock et al. | |
| 6,328,660 | B1 | 12/2001 | Bunn, III | |
| 6,366,205 | B1 | 4/2002 | Sutphen | 340/568.6 |
| 6,390,934 | B1 | 5/2002 | Winfield et al. | |
| 6,398,670 | B1 | 6/2002 | Engelhardt et al. | |
| 6,410,990 | B2 | 6/2002 | Taylor et al. | |
| 6,411,211 | B1 | 6/2002 | Boley et al. | 340/568.69 |
| 6,431,990 | B1 | 8/2002 | Manwaring | |
| 6,441,745 | B1 | 8/2002 | Gates | |
| 6,465,986 | B1 | 10/2002 | Haba | 320/116 |
| 6,488,591 | B1 | 12/2002 | Gobush et al. | |
| 6,500,073 | B1 | 12/2002 | Gobush et al. | |
| 6,506,124 | B1 | 1/2003 | Manwaring et al. | |
| 6,514,081 | B1 | 2/2003 | Menggoli | 434/252 |
| 6,519,545 | B1 | 2/2003 | Amano | 702/127 |
| 6,523,964 | B2 | 2/2003 | Schofield et al. | 359/601 |
| 6,533,674 | B1 | 3/2003 | Gobush | |
| 6,561,917 | B2 | 5/2003 | Manwaring | |
| 6,567,536 | B2 | 5/2003 | McNitt et al. | 382/107 |
| 6,577,238 | B1 | 6/2003 | Whitesmith et al. | 340/572.1 |
| 6,579,190 | B2 | 6/2003 | Yamamoto | 473/141 |
| 6,592,465 | B2 | 7/2003 | Lutz et al. | |
| 6,602,144 | B2 | 8/2003 | Manwaring et al. | |
| 6,607,123 | B1 | 8/2003 | Jollifee et al. | 235/375 |
| 6,616,543 | B1 | 9/2003 | Gobush et al. | |
| 6,631,616 | B2 * | 10/2003 | Wisniewski et al. | 62/66 |
| 6,638,175 | B2 | 10/2003 | Lee et al. | |
| 6,758,759 | B2 | 7/2004 | Gobush et al. | 473/131 |
| 6,764,412 | B2 | 7/2004 | Gobush et al. | |
| 6,781,621 | B1 | 8/2004 | Gobush et al. | 348/157 |
| 6,782,118 | B2 | 8/2004 | Verga | 382/106 |
| 6,802,617 | B2 | 10/2004 | Schofield | 359/601 |
| 6,908,404 | B1 | 6/2005 | Gard | 473/407 |
| 6,920,614 | B1 | 7/2005 | Schindler et al. | 715/726 |
| 6,956,614 | B1 | 10/2005 | Quintna et al. | 348/373 |
| 6,974,395 | B1 | 12/2005 | Rioux et al. | 473/409 |
| 6,982,132 | B1 | 1/2006 | Goldner et al. | 429/162 |
| 7,063,256 | B2 | 6/2006 | Anderson et al. | 235/385 |
| 7,184,569 | B2 | 2/2007 | Lawandy et al. | 382/100 |
| 7,209,576 | B2 | 4/2007 | Rankin | 382/107 |
| 7,283,647 | B2 | 10/2007 | McNirr | 382/107 |
| 7,311,611 | B2 | 12/2007 | Cameron et al. | 473/221 |
| 7,422,365 | B2 * | 9/2008 | Chamberlain et al. | 374/120 |
| 2001/0029207 | A1 | 10/2001 | Cameron et al. | |
| 2001/0043757 | A1 | 11/2001 | Asakura | |
| 2002/0022531 | A1 | 2/2002 | Katayama | |
| 2002/0030527 | A1 | 3/2002 | Hung et al. | |
| 2002/0064764 | A1 | 5/2002 | Fishman et al. | |
| 2002/0077164 | A1 | 6/2002 | Sundstrom | |
| 2002/0085213 | A1 | 7/2002 | Yamamoto et al. | |
| 2002/0097471 | A1 * | 7/2002 | Bethea et al. | 359/172 |
| 2002/0103035 | A1 | 8/2002 | Lindsay | |
| 2002/0155896 | A1 | 10/2002 | Gobush et al. | |
| 2002/0173364 | A1 | 11/2002 | Boscha | |
| 2002/0173367 | A1 | 11/2002 | Gobush et al. | |
| 2002/0177490 | A1 | 11/2002 | Yong et al. | |
| 2003/0062080 | A1 | 4/2003 | Satoh et al. | |
| 2003/0066295 | A1 * | 4/2003 | Wisniewski et al. | 62/66 |
| 2003/0103684 | A1 | 6/2003 | Gobush et al. | |
| 2003/0109322 | A1 | 6/2003 | Funk et al. | |
| 2003/0130054 | A1 | 7/2003 | Bissonnette et al. | |
| 2004/0030527 | A1 | 2/2004 | Rankin | |
| 2004/0032970 | A1 | 2/2004 | Kiraly | |
| 2004/0142772 | A1 | 7/2004 | Asakura | |
| 2004/0162154 | A1 | 8/2004 | DeJohn | |
| 2004/0209698 | A1 | 10/2004 | Ueda et al. | |
| 2004/0241630 | A1 | 12/2004 | Hutchon et al. | |
| 2004/0242677 | A1 | 12/2004 | Uebbing et al. | |
| 2004/0248662 | A1 | 12/2004 | Gobush et al. | |
| 2004/0259653 | A1 | 12/2004 | Gobush et al. | |
| 2005/0002435 | A1 * | 1/2005 | Hashimoto et al. | 374/43 |
| 2005/0063595 | A1 | 3/2005 | Bissonnette et al. | |
| 2005/0085309 | A1 | 4/2005 | McGann et al. | |
| 2005/0153785 | A1 | 7/2005 | Sun | |
| 2005/0272512 | A1 | 12/2005 | Bissonnette et al. | |
| 2005/0282645 | A1 | 12/2005 | Bissonnette et al. | |
| 2007/0089066 | A1 | 4/2007 | Chaudhri et al. | |
| 2007/0111767 | A1 | 5/2007 | Brown et al. | |

OTHER PUBLICATIONS

U.S. Appl. No. 10/759,080, filed Jan. 20, 2004 entitled "One Camera Club Monitor".

U.S. Appl. No. 10/667,479, filed Sep. 23, 2003 entitled "Golf Club and Ball Performance Having An Ultrasonic Trigger".

U.S. Appl. No. 10/667,478, filed Sep. 23, 2003 entitled "Golf Club and Ball Performance Monitor With Automatic Pattern Recognition".

U.S. Appl. No. 10/656,882, filed Sep. 8, 2003 entitled "Multishutter Club-Ball Analyzer".

Tiger Woods PGA Tour 2001. "GameSpot." Feb. 26, 2001. http://www.gamespot.com/ps2/sports/tigerwoodspgatour2001/idex.html.

"EA Sports ships Tiger Woods PS2."GameSpot. Feb. 26, 2001. http://www.gamespot.com/ps2/sports/tigerwoodsptatour2001/news.html?sid=2690628&om_act=covert&om_clk=newsfeatures&tag=newsfeatures;title;3>.

SearchUnifiedCommunications.com, Data Transfer Rate. pp. 1-3. Retrieved from http://searchunifiedcommunications.techtarget.com/sDefinition/0,,sid186_gci213492,00.html on Mar. 3, 2008.

* cited by examiner

INFRARED SENSING LAUNCH MONITOR

FIELD OF THE INVENTION

The present invention relates to a method and apparatus for monitoring the trajectory of a golf object. More specifically, the present invention relates to a method and apparatus for changing the temperature pattern of the surface of a golf ball or golf club in order to determine its kinematic characteristics.

BACKGROUND OF THE INVENTION

Golfers of all skill levels are constantly trying to improve their game and lower their score. Many take advantage of improved equipment such as golf clubs and golf balls. Golfers may even hire coaches to help fine tune the mechanics of their swing. Perfecting the mechanics of a golf swing is important because even small changes can greatly affect the trajectory of the ball.

Typically, a golfer wants to strike the ball such that it has desired kinematic characteristics, such as side spin, back spin, and velocity. A golfer can determine if their swing is producing the desired characteristics in many ways. One rudimentary method involves observing the golf ball after it has been struck by the club. A "good" shot typically reaches the location desired by the golfer. However, this method has its drawbacks. For example, a golf ball may reach a desired location even when it has less than optimal kinematic characteristics. Simply observing the golf ball with the naked eye doesn't allow a golfer to determine the kinematic characteristics of the ball or change their swing to achieve desired characteristics.

More advanced systems involve apparatus that are capable of imaging the golf club and/or golf ball in order to determine how a golfers swing affects the trajectory of the ball. These systems typically involve one or more imaging systems, lamps, reflectors, and motion detectors. Typically, these apparatus acquire images of the golf club and/or golf ball in motion. Once the images are acquired, they may be analyzed to determine the kinematic characteristics of the club and/or ball. These systems are useful because they can correlate the motion of the club with the resultant trajectory of the ball.

In many of these more advanced systems, the golf club and/or ball needs to be marked. Rudimentary markers may involve colored markers that are strategically placed on the surface of the golf club or golf ball. However, colored markers have several disadvantages. One disadvantage of colored markers is that they are difficult to distinguish because of background light, such as sunlight and the like. Another disadvantage of using colored markers is that they do not allow an imaging system to distinguish them from the color of the golf ball. Distinguishing the markers from the golf ball surface is important because measurements are determined based on the change in the position of the markers.

More advanced systems use retroreflective markers or limited spectrum markers that are placed on the surface of the golf ball or club. Retroreflective markers provide the advantage of reflecting light with a higher intensity than the light which they receive. Retroreflective markers however, have limited applications. One limitation of retroreflective markers is that they typically only reflect light on-axis. In other words, it is preferred that the light source strikes the markers on-axis. In response, the markers reflect light with the highest intensity on the same axis. This requires light sources and imaging systems to be properly positioned in order to achieve optimal results.

Limited spectrum markers may also be used on the surface of golf clubs or balls. Limited spectrum markers are typically only responsive to one wavelength of light. In response to a received wavelength of light, the markers emit light of a different wavelength. One example of a limited spectrum marker is a fluorescent marker. Fluorescent markers respond to a received wavelength by emitting a second wavelength of light. Using limited spectrum markers reduces the interference from ambient light because the wavelength of light emitted by the fluorescent markers may be filtered before being imaged. In other words, a filter may be placed before the imaging system such that light of only one wavelength, within a desired tolerance, may be imaged. This is especially helpful in situations that have high intensity ambient light, such as sunlight. Limited spectrum markers, however, have some limitations. For example, the imaging system must have a filter in order to isolate the light reflected by the markers. This may require a particular apparatus to be more complex or bulky. In addition, limited spectrum markers and filters must be chosen before testing begins, thereby reducing the adaptability of the apparatus.

Regardless of the type of markers that are used, they are typically placed in a desired pattern or orientation. It is usually desirable to orient the markers such that they are all visible to an imaging system. The number and pattern of the markers may altered based on the information that is desired. For example, it is common to position five markers at the vertices of a pentagon with one marker in the middle. The markers are then imaged at least twice. Golf clubs are typically imaged twice on the downswing, while golf balls may be imaged at least twice after impact. The changes in the position of the markers may then be analyzed, using a variety of well known algorithms, to determine the kinematic characteristics of the golf club and/or ball.

One limitation of using a marker, such as colored, retroreflective, or limited spectrum markers, is that they must be placed on the golf club or ball prior to using a particular apparatus. In addition, as described above, the markers are usually placed in a desired pattern and orientation prior to use. Thus, many apparatus available today do not allow a golfer to use their own equipment. Rather, a golfer must use the previously prepared golf clubs and balls that have markers placed on them.

A continuing need exists for a monitoring apparatus and method that does not require previously prepared golf clubs and/or golf balls.

SUMMARY OF THE INVENTION

The present invention relates to a golf club and ball monitoring apparatus and method. Specifically, the present invention comprises an apparatus and method that is capable of creating an uneven temperature pattern on the surface of golf equipment. The uneven temperature pattern is preferably created on the surface of the golf equipment in a predetermined configuration and orientation. Preferably, the uneven temperature pattern is capable of being detected by a thermal sensor. Images of the uneven temperature pattern may then be analyzed to determine the kinematic characteristics of the ball.

One advantage of creating an uneven temperature pattern on the surface of golf equipment is that markers do not have to be placed on their surface prior to use with a launch monitor. Preferably, the present invention is capable of imparting the uneven temperature pattern to the golf equipment such that it is detectable by a thermal sensor for a desired amount of time. For example, a player may have the uneven temperature pattern imparted to their club and ball. The player may then swing the club and strike the ball while it is within the field of view of a launch monitor. When the player is monitored while the uneven temperature pattern is detectable, a launch monitor is able to obtain an analysis of their club swing and resultant ball trajectory. In one aspect of the present invention, specially marked equipment does not have to be used. Rather, an apparatus that is capable of imparting the uneven temperature pattern to any golf equipment may be used. It may be desirable to configure and dimension the apparatus such that it is capable of efficiently imparting a desired temperature pattern to, for example, a golf club and/or golf ball.

In one embodiment, the present invention comprises an apparatus for measuring the flight characteristics of golf equipment. The apparatus includes a golf club, golf ball, and at least one infrared sensing device selectively positioned to acquire images of at least one of the golf club and the golf ball. The infrared sensing device is preferably capable of detecting a temperature pattern on a portion of the surface of at least one of the golf club and the golf ball.

The present invention may further comprise a heating device or cooling device. The heating device may comprise a focused emitting device, or at least one laser. In another aspect of the present invention, the temperature pattern is imparted by cooling portions of the golf club and golf ball. Alternately, the temperature pattern may be imparted by heating portions of the golf club and golf ball. The temperature pattern may be imparted from a predetermined distance. Preferably, the predetermined distance is about 3 feet or greater. More preferably, the predetermined distance is about 4 feet or greater. Most preferably, the predetermined distance is between 0.5 inches and about 2 feet.

In one embodiment, the time period necessary to impart the temperature pattern is between about 5 seconds and about 30 seconds. More preferably, the time period necessary to impart the temperature pattern is about 1 minute or less. According to one aspect of the present invention, the heating device is capable of raising the temperature of portions of the golf club and golf ball by about 10° F. or more. More preferably, the heating device is capable of raising the temperature of portions of the golf club and golf ball by about 20° F. or more. In other embodiments, the cooling device is capable of lowering the temperature of portions of the golf club and golf ball by about 10° F. or more. More preferably, the cooling device is capable of lowering the temperature of portions of the golf club and golf ball by about 20° F. or more.

In one embodiment, the cooling device may comprise a plurality of protrusions that are capable of resting flush with the surface of at least one of the golf club and golf ball. In another embodiment, the heating device is capable of imparting the temperature pattern to the surface of at least one of the golf club and golf ball in about 30 seconds or less. Similarly, the cooling device may be capable of imparting the temperature pattern to the surface of at least one of the golf club and golf ball in about 30 seconds or less.

According to another aspect, the present invention comprises an apparatus for determining the flight characteristics of a golf ball. The apparatus includes a thermal device capable of imparting a temperature pattern to a portion of the surface of the golf ball and a thermal imaging device capable of detecting and acquiring images of the temperature pattern. The images of the temperature pattern may be analyzed to determine the kinematic characteristics of the golf ball. It may be desirable to include a processor capable of analyzing the images of the temperature pattern.

In another embodiment, the present invention comprises a method of determining the flight characteristics of a golf ball. The method may include imparting a temperature pattern to a portion of the surface of a golf ball and detecting the temperature pattern based on a thermal detection device. The difference between the temperature pattern and other portions of the surface of the golf ball may be about 10° F. or more. The method may further comprise acquiring images of the temperature pattern and processing the images to determine the kinematic characteristics of the golf ball. The kinematic characteristics may include at least one of side spin, back spin, trajectory, and velocity. Preferably, the temperature pattern is imparted in about 1 minute or less.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1A:
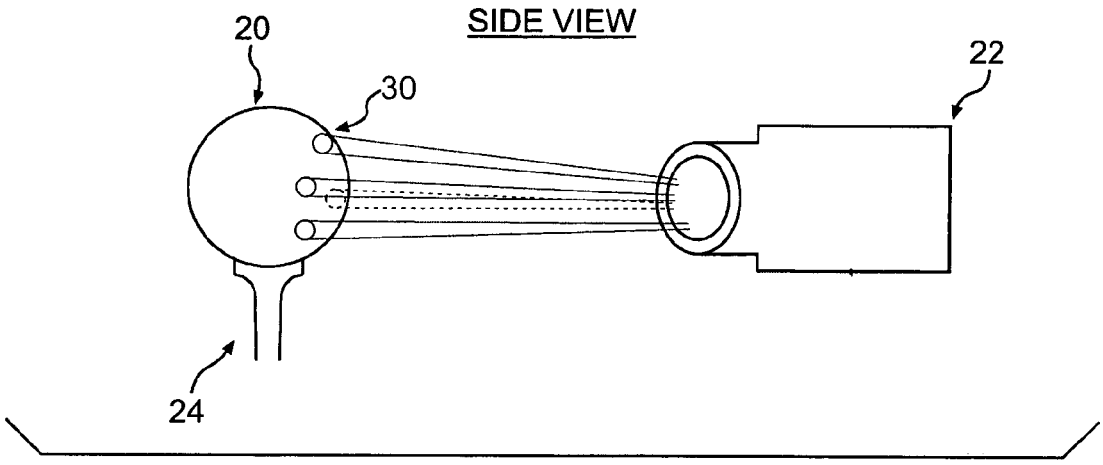
FIG. 1A is a diagram showing one embodiment of a heating apparatus according to the present invention.

Golf club and ball monitors are commonly referred to as "launch monitors." Launch monitors are typically used in isolated environments, such as test ranges or other areas that are specifically configured to allow monitoring of golf equipment. As described above, it is desirable to position markers on a piece of golf equipment such that they can be used to accurately determine the kinematic characteristics of the equipment. The combination of having to use an isolated testing environment and "pre-marked" equipment leaves room for many improvements.

Launch monitors are becoming increasingly versatile. For instance, newer launch monitors are portable, allowing them to be used on a golf course. This provides the advantage of allowing a player to monitor their swing and resultant ball trajectory in a more realistic setting. One such launch monitor is described in U.S. patent application Ser. No. 10/861,443, entitled "Launch Monitor," which is incorporated herein in its entirety. In combination with the present invention, a portable launch monitor may reduce the restrictions and preparation that is currently necessary in order to monitor a golfers swing and ball trajectory.

The present invention relates to a golf club and ball monitoring apparatus and method. Specifically, the present invention comprises an apparatus and method that is capable of creating an uneven temperature pattern on the surface of golf equipment. The uneven temperature pattern is preferably created on the surface of the golf equipment in a predetermined configuration and orientation. Preferably, the uneven temperature pattern is capable of being detected by a thermal sensor. Images of the uneven temperature pattern may then be analyzed to determine the kinematic characteristics of the ball.

One advantage of creating an uneven temperature pattern on the surface of golf equipment is that markers do not have to be placed on their surface prior to use with a launch monitor. Preferably, the present invention is capable of imparting the uneven temperature pattern to the golf equipment such that it is detectable by a thermal sensor for a desired amount of time. For example, a player may have the uneven temperature pattern imparted to their club and ball. The player may then swing the club and strike the ball while it is within the field of view of a launch monitor. When the player is monitored while the uneven temperature pattern is detectable, a launch monitor is able to obtain an analysis of their club swing and resultant ball trajectory.

In one aspect of the present invention, specially marked equipment does not have to be used. Rather, an apparatus that is capable of imparting the uneven temperature pattern to golf equipment may be used. It may be desirable to configure and dimension the apparatus such that it is capable of efficiently imparting a desired temperature pattern to, for example, a golf club and/or golf ball. Although the present invention is described with respect to golf equipment, it will be understood that the present invention may be modified or adapted for use with any type of equipment. For example, the present invention may be adapted for use with hockey equipment, baseball equipment, tennis equipment, and the like.

In one embodiment, the uneven temperature pattern may be imparted by increasing or decreasing the temperature of portions of the surface of a golf club or golf ball. In other words, portions of the surface of the golf club and/or ball may be heated or cooled, which results in an uneven temperature pattern. The uneven temperature pattern may be configured and oriented similar to the manner in which markers are applied to golf equipment. That is, the uneven temperature pattern may be imparted onto the surface of a golf club or ball such that it is visible to imaging equipment. In addition, the uneven temperature pattern may be imparted such that images of the temperature pattern may provide sufficient information to analyze club motion and/or ball flight. The uneven temperature pattern may include any desired pattern. The pattern may include, but is not limited to, dots, lines, cross hatches, logo's, letters, and the like.

Once the temperature pattern is created on the surface of the golf club and/or ball, a sensing device such as a thermal sensor, infrared sensing device, or the like, may be used to detect radiant energy emitted by the ball. In one embodiment, the radiant energy is emitted in the form of infrared radiation for a predetermined period of time. Once the golf club and/or ball pass through the field of view of the sensing equipment, an imaging device captures two or more images of the golf club and/or ball. The images may then be analyzed by a processor, such as a computer, and the like. In other embodiments, the present invention may use discrete images taken at predetermined time intervals. Alternately, the present invention may use a continuous video of the club swing and ball flight path that is taken for a desired period of time. In one embodiment, it may be possible to track a golf ball throughout its entire flight based on the uneven temperature pattern imparted to the surface of the ball, as described in greater detail below.

In one embodiment, the present invention may be used to monitor the flight of a golf ball. The uneven temperature pattern is preferably created by a thermal device that is capable of imparting a desired temperature pattern to the surface of the golf ball within a desired period of time. The thermal device used to impart the uneven temperature pattern may be based on heating or cooling. In other words, a heating device or cooling device may be used to change the temperature of the surface of the golf ball.

When a heating device is used, it is desirable for the heat to be applied from a distance. One advantage of applying heat from a distance is that the ball may be placed, for example, on a tee and heated continuously until it is impacted by the club. This would allow the uneven temperature pattern to be maintained, allowing the temperature pattern to be more easily detected by the thermal imaging device. In order to allow heat to be applied from a distance in a distinct pattern and configuration, it is desirable for the heating device to be capable of focusing heat over a small area with high intensity.

FIG. 1A is a diagram showing one example of a heating apparatus that may be used in accordance with the present invention. As shown in the FIG. 1A embodiment, a heating device may be used to impart an uneven temperature pattern to the surface of the golf ball 20. The heating device comprises, for example, a focused emitting device 22 capable of imparting the desired temperature pattern. It is desirable that such a device is capable of imparting a uneven temperature pattern while positioned away from the ball by a predetermined distance. In one embodiment, the heating device 22 may be used to impart a temperature pattern onto a golf ball 20. Preferably, the heating device 22 is capable of imparting a temperature pattern onto the ball 20 from a distance of about 2 feet or greater. More preferably, the heating device 22 is capable of imparting a temperature pattern onto the ball 20 from a distance of about 3 feet or greater. Most preferably, the heating device 22 is capable of imparting a temperature pattern onto the ball 20 from a distance of about 4 feet or greater. In another embodiment, the heating device 22 may be capable of imparting a temperature pattern onto the ball 20 from a distance between about 1 inch and about 6 feet. More preferably, the heating device 22 may be capable of imparting a temperature pattern onto the ball 20 from a distance of between about 0.5 inches and about 2 feet. Most preferably, the heating device 22 may be capable of imparting a temperature pattern onto the ball 20 from a distance of between about 0.8 feet and about 1.5 feet.

In one embodiment, shown in FIG. 1A, the focused emitting device 22 is capable of imparting a heating pattern 30 onto the golf ball 20 while it is resting on a tee 24. The focused emitting device 22 may be operatively connected to a launch monitor, or alternately it may be a separate element. According to one aspect of this embodiment, the golf ball 20 may be positioned in any orientation on the tee 24. Once the golf ball 20 has been placed on the tee 24, the focused emitting device 22 may begin to impart a heated pattern 30 onto the surface of the golf ball. The temperature of the heated pattern 30 is preferably sufficient to be detected by the thermal imaging device or the like. However, the temperature of the heated pattern 30 is preferably not so high that the playing characteristics of the golf ball are changed greatly. In one embodiment, the focused emitting device 22 may heat the ball for a predetermined amount of time, or alternately it may heat the ball constantly while it is on the tee 24.

It may be desirable to allow the ball 20 to rest on the tee 24 for a predetermined period of time in order to allow the emitting device 22 sufficient time to impart the heated pattern 30. The time that is sufficient to impart the heated pattern 30 may depend on the intensity of the heating device. In one embodiment, the heating is preferably done for a minimum length of time in order to produce the desired temperature changes. One advantage of minimizing the length of time is that downtime may be reduced.

Preferably, the time period necessary for the heating device to impart a heated pattern 30 is between about 5 seconds and about 30 seconds. More preferably, the time period necessary for the heating device to impart the heated pattern 30 is between about 15 seconds and about 25 seconds. In another embodiment, the time period necessary for a heating device to impart the heated pattern 30 is preferably about 1 minute or less. More preferably, the time period necessary for the heating device to impart the heated pattern 30 may be about 45 seconds or less. Most preferably, the time period necessary for the heating device to impart the heated pattern 30 may be about 30 seconds or less.

As mentioned above, the time necessary for the heating device to impart the heated pattern 30 may depend on the intensity of the heating device. One way to describe the intensity of the heating device is by the temperature change that it is capable of imparting over a fixed period of time. Preferably, the heating device is capable of causing about a 10° F. temperature change of the surface a golf ball within about 20 seconds or less. More preferably, the heating device is capable of causing about a 10° F. temperature change of the surface a golf ball within about 15 seconds or less. Most preferably, the heating device is capable of causing about a 10° F. temperature change of the surface a golf ball within about 10 seconds or less.

Another way to describe the intensity of the heating device is by the temperature change that it is capable of producing in desired portions of the golf ball. Preferably, the heating device is capable of raising the temperature of portions of the golf ball by about 10° F. or more. More preferably, the heating device is capable of raising the temperature of portions of the golf ball by about 20° F. or more. Most preferably, the heating device is capable of raising the temperature of portions of the golf ball by about 30° F. or more.

In one embodiment, it is desirable for the temperature of the heated pattern 30 to be higher than the rest of the surface of the golf ball 20. This is desirable because it allows a launch monitor, thermal imaging device, or the like to distinguish the heated pattern 30 from the other portions of the golf ball. Preferably, the temperature different between the heated pattern and other portions of the golf ball is about 10° F. or more. More preferably, the temperature difference between the heated pattern and other portions of the golf ball is about 20° F. or more. Most preferably, the temperature difference between the heated pattern and other portions of the golf ball is about 30° F. or more. Alternately, the temperature of the heated pattern may be between about 60° F. and about 120° F. More preferably, the temperature of the heated pattern may be between about 80° F. and about 105° F. Most preferably, the temperature of the heated pattern may be between about 90° F. and about 100° F.

In other embodiments, the heating apparatus may comprise a plurality of protrusions that are capable of resting flush with the surface of a golf ball. The protrusions may be capable of imparting the heated pattern 30 through direct contact with the surface of the golf ball. In such embodiments, the heating apparatus may include a indicator that informs a golfer when the heated pattern 30 has been imparted. One example of such an apparatus is described below with respect to a cooling apparatus. It will be understood that the apparatus described below with respect to FIG. 1B may be modified and adapted for use as a heating apparatus.

Figure 1B:
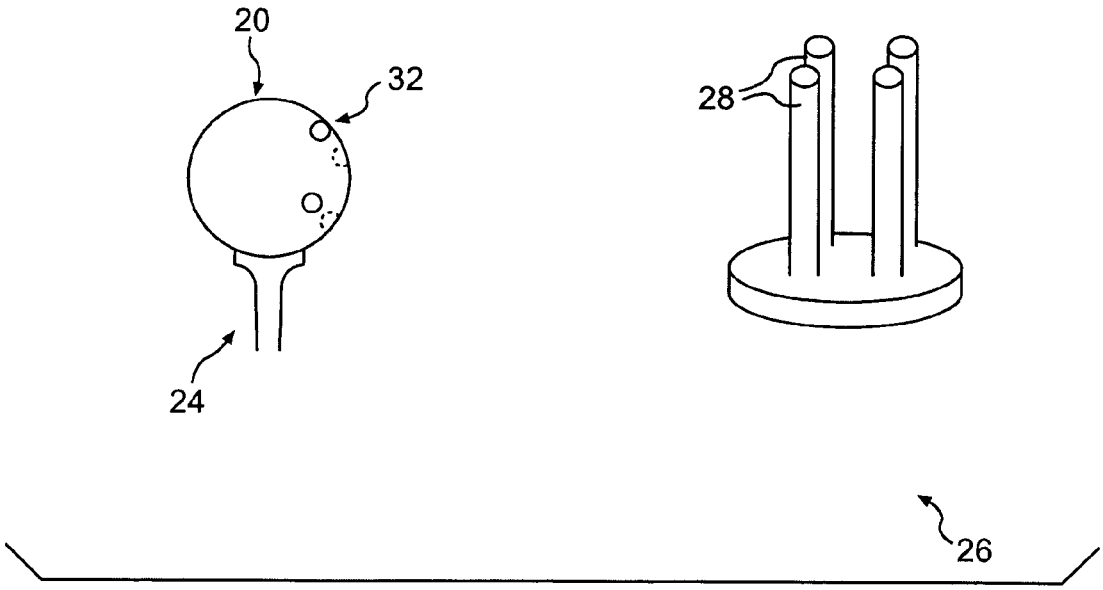
FIG. 1B is a diagram showing one embodiment of a cooling apparatus according to the present invention.

As mentioned above, the uneven temperature pattern may be imparted onto the golf ball based on a cooling apparatus. It may be desirable for the cooling apparatus to be in direct contact with the golf ball in order to impart the desired temperature pattern. FIG. 1B is a diagram showing one embodiment of a cooling apparatus that may be used in accordance with the present invention. In one embodiment, shown in FIG. 1B, the cooling apparatus 26 preferably imparts a cooled pattern 32 onto the golf ball 20 before it is placed onto the tee 24. The cooling apparatus 26 may be operatively connected to a launch monitor, or alternately it may be a separate element.

In one embodiment, the cooling apparatus 26 preferably comprises two or more protrusions, or prongs 28, that are capable of maintaining flush contact with the surface of the ball 20. In other embodiments, the cooling apparatus 26 may comprise cold stamps or other physical devices that are capable of imparting a cooled pattern 32 onto the surface of the ball 20. The cooling apparatus 28 may include a coolant that is capable of cooling at least the portion of the protrusions that contact the ball 20. Any coolant known to those skilled in the art may be used. Coolants that may be used include, but are not limited to, ice, liquid nitrogen, Freon, and the like. The cooling apparatus 28 is preferably capable of decreasing the temperature of portions of the surface of the ball 20 such that the cooled portions are capable of being detected. However, the temperature of the cooled pattern 32 is preferably not so cold that the playing characteristics of the ball are changed greatly.

The ball 20 may be placed on the cooling apparatus 26 for a predetermined amount of time in order to impart the cooled pattern 32. The predetermined amount of time may depend on the intensity of the cooling apparatus 26. After the predetermined amount of time, the ball 20 may be placed onto the tee 24 such that the cooled pattern 32 is capable of being detected and imaged by a launch monitor, thermal imaging device, or the like. In one embodiment, the cooling is preferably done for a minimum length of time in order to produce the desired temperature changes. One advantage of minimizing the length of time is that downtime may be reduced while still allowing the cooled pattern 32 to be detected.

Preferably, the time period necessary for the cooling apparatus to impart a cooled pattern 32 is between about 5 seconds and about 30 seconds. More preferably, the time period necessary for the cooling apparatus to impart a cooled pattern 32 is between about 15 seconds and about 25 seconds. In another embodiment, the time period necessary for the cooling apparatus 32 to impart the cooled pattern 32 is preferably about 1 minute or less. More preferably, the time period necessary for the cooling apparatus 32 to impart the cooled pattern 32 may be about 45 seconds or less. Most preferably, the time period necessary for the cooling apparatus 32 to impart the cooled pattern 32 may be about 30 seconds or less.

As mentioned above, the time necessary for the cooling apparatus to impart the cooled pattern 32 may depend on the intensity of the cooling apparatus. One way to describe the intensity of the cooling apparatus is by the temperature change that it is capable of imparting over a fixed period of time. Preferably, the cooling apparatus is capable of causing about a 10° F. temperature change of the surface of a golf ball within about 20 seconds or less. More preferably, the cooling apparatus is capable of causing about a 10° F. temperature change of the surface of a golf ball within about 15 seconds or less. Most preferably, the cooling apparatus is capable of causing about a 10° F. temperature change of the surface of a golf ball within about 10 seconds or less.

Another way to describe the intensity of the cooling apparatus is by the change in temperature that it is capable of imparting to portions of the golf ball. Preferably, the cooling apparatus is capable of lowering the temperature of portions of the golf ball by about 10° F. or more. More preferably, the cooling apparatus is capable of lowering the temperature of portions of the golf ball by about 20° F. or more. Most preferably, the cooling apparatus is capable of lowering the temperature of portions of the golf ball by about 30° F. or more.

In one embodiment, it is desirable for the temperature of the cooled pattern 32 to be substantially lower than the rest of the surface of the golf ball 20. This is desirable because it allows a launch monitor or other sensing device to distinguish the cooled pattern 32 from the other portions of the golf ball. Preferably, the temperature difference between the cooled pattern and other portions of the golf ball is about 10° F. or more. More preferably, the temperature difference between the cooled pattern and other portions of the golf ball is about 20° F. or more. Most preferably, the temperature difference between the cooled pattern and other portions of the golf ball is about 30° F. or more. Alternately, the temperature of the cooled pattern may be between about 0° F. and about 50° F. More preferably, the temperature of the cooled pattern may be between about 10° F. and about 30° F. Most preferably, the temperature of the cooled pattern may be between about 15° F. and about 25° F.

Figure 2:
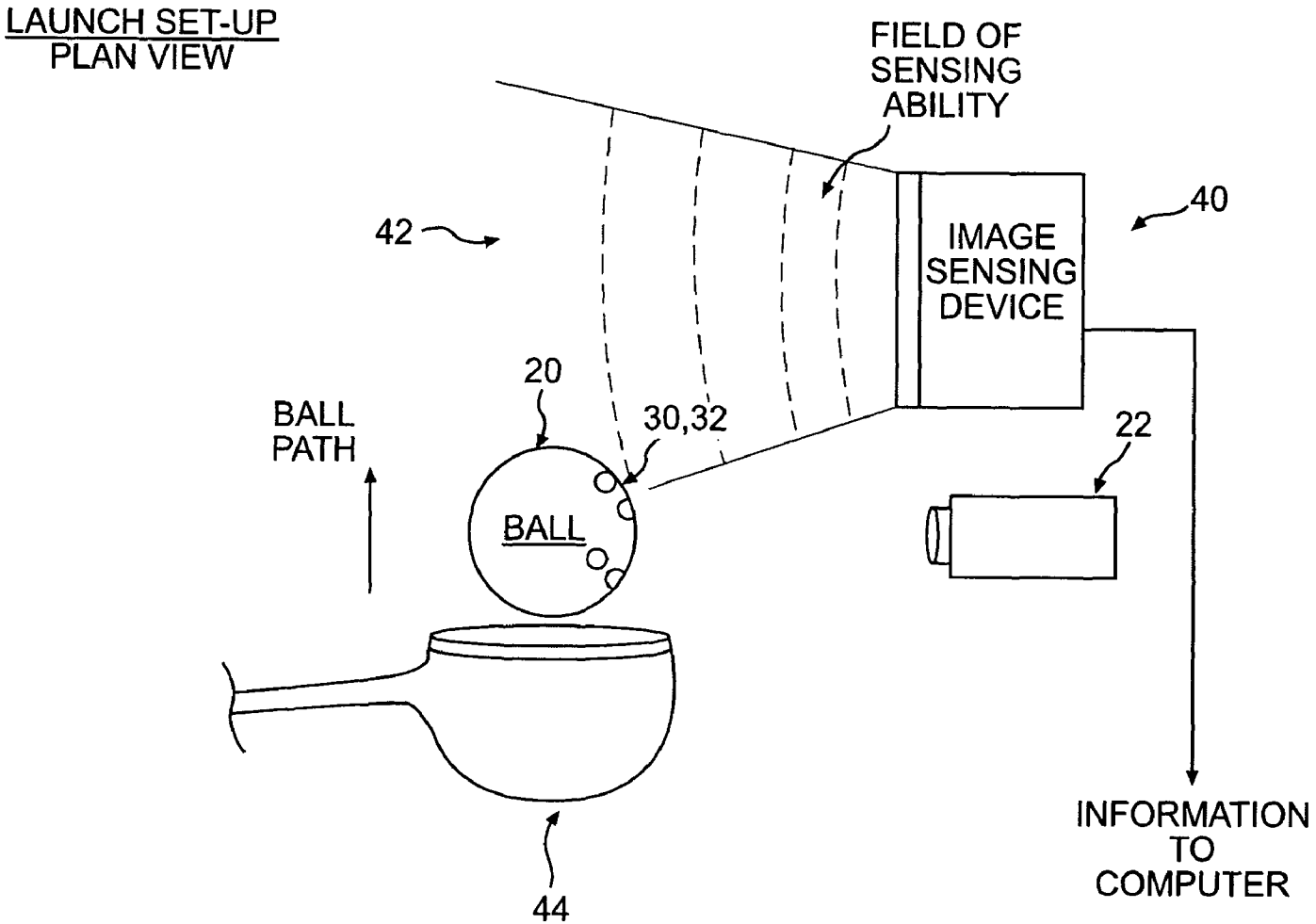
FIG. 2 is a diagram showing an overview of one exemplary embodiment according to the present invention.

FIG. 2 is a diagram showing an overview of one exemplary configuration according to the present invention. As shown in FIG. 2, a golf ball 20 may be placed on a tee (not shown). The golf ball 20 is preferably positioned such that the heating device 22 is capable of imparting a heated pattern 30 onto the ball 20. An image sensing device 40 may also be selectively positioned such that it is downrange from the ball 20, allowing it to acquire images of the ball in flight. The image sensing device 40 may be part of a launch monitor, or alternately it may be a separate element that is operatively connected to the launch monitor. It may be desirable to position it such that the ball is just outside its field of view 42, as shown in FIG. 2. Positioning the device 40 such that the ball 20 is just outside the field of view 42 allows it to acquire images of the golf ball immediately after it has been struck by a golf club 44. In embodiments that employ a cooling apparatus 26, the position of the cooling apparatus may not be important. For example, the cooling apparatus 26 may be positioned substantially close to the launch monitor such that a cooled pattern 32 could be imparted and the golf ball 20 could be placed on the tee within a substantially small amount of time. However, the particular placement of the cooling apparatus may be varied as desired because the ball is not being cooled when it is positioned on the tee.

Figure 3:
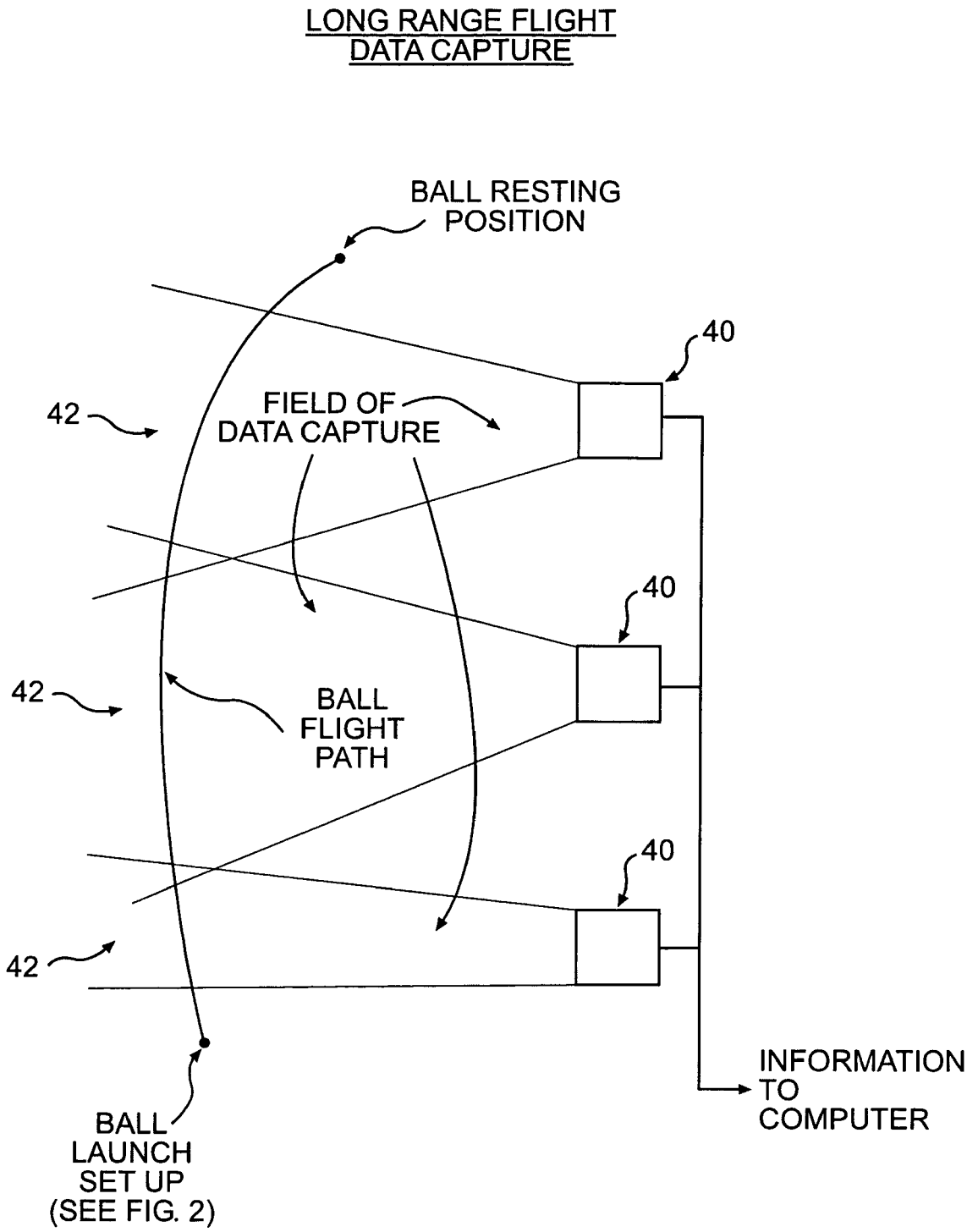
FIG. 3 is a diagram showing an overview of another exemplary embodiment according to the present invention.

In one embodiment, the image sensing device is preferably capable of acquiring images and detecting the heated or cooled pattern on the surface of the golf ball 20. Preferably, the image sensing device includes infrared sensing equipment. Any known infrared sensing equipment known to those skilled in the art may be used. The image sensing device preferably acquires images of the golf ball substantially immediately after it is struck by the club. This is well known to those skilled in the art. The image sensing device 40 may acquire two or more discrete images of the golf ball 20 in flight. Alternately, the image sensing device 40 may be capable of acquiring a continuous video of the flight of the golf ball. In other embodiments, a plurality of image sensing devices 40 may be positioned downrange from the golf ball, as shown in FIG. 3. In this aspect of the present invention, the plurality of image sensing devices 40 may be used to acquire discrete or continuous images of the golf ball. One advantage of using a plurality of devices 40 is that information about the golf ball during its entire flight may be acquired.

In embodiments that use a focused emitting device 22, as described with respect to FIG. 1A, the heated pattern may be imparted while the golf ball 20 is positioned on the tee. In this embodiment, the golf ball may be struck and subsequently imaged at any time because the emitting device 22 may be capable of constantly applying the heated pattern 30. However, in other embodiments that do not apply a heated pattern while the ball is on the tee, or in embodiments that employ a cooling apparatus, it may be desirable for the heated or cooled pattern on the golf ball to be imaged soon after it is imparted. One advantage of imaging the ball 20 soon after the pattern is imparted is that the images may be more accurate because the temperature differential between the heated or cooled pattern and the other portions of the ball may be maximized.

Because time is consumed in moving the ball from a heating or cooling apparatus to the tee, and while the golfer prepares to strike the ball, it is desirable for the heated or cooled patterns to be capable of being imaged at a desired period of time after the patterns have been applied. The image sensing device 40 is preferably capable of detecting the heated or cooled pattern even if time elapses between the time the pattern is imparted and the time the ball is impacted.

Preferably, the heated or cooled pattern is capable of being imaged about 1 minute or more after it is imparted. More preferably, the heated or cooled pattern is capable of being imaged about 2 minutes or more after being imparted. Most preferably, the heated or cooled pattern is capable of being imaged about 3 minutes or more after being imparted. Alternately, the heated or cooled pattern is capable of being imaged between about 0 and about 2 minutes after being imparted. More preferably, the heated or cooled pattern is capable of being imaged between about 20 seconds and about 50 seconds after being imparted. Most preferably, the heated or cooled pattern is capable of being imaged between about 30 and about 40 seconds after being imparted.

The image sensing device 40 may be operatively connected to a processor, such as computer or the like. The processor may be part of a launch monitor, or alternately it may be a separate element. The processor is preferably capable of analyzing images of the ball to determine its kinematic characteristics. These characteristics may include, but are not limited to, spin rates, launch angles, ball translation, speed, direction, and the like. This method of determine the kinematic characteristics of a golf ball is well known to those skilled in the art. Some examples of such an analysis are described in U.S. Pat. Nos. 6,488,591, 6,500,073, 6,533,674, 6,616,543, 6,764,412 and 6,241,622, each of which are incorporated herein in their entireties.

Although the present invention has been described with respect to a golf ball 20, it is capable of being adapted for use with any other golf equipment, such as a golf club. The heating and cooling apparatus described above may be capable of being adapted to impart an uneven temperature pattern to the surface of the golf club. The golf club may then be imaged using, for example, an image sensing device that is selectively positioned to monitor the club swing.

Although the present invention has been described with reference to particular embodiments, it will be understood to those skilled in the art that the invention is capable of a variety of alternative embodiments within the spirit of the appended claims.

The invention claimed is:

1. An apparatus for measuring the flight characteristics of golf equipment, comprising:

a golf club and a golf ball;

at least one infrared sensing device selectively positioned to acquire images of at least one of the golf club and the golf ball; and a cooling device having at least one contact surface operable to temporarily maintain contact with at least one portion of the surface of at least one of the golf club and the golf ball to impart a temperature pattern to the at least one portion of the surface of at least one of the golf club and the golf ball;

wherein the infrared sensing device is operable to detect a temperature pattern on a portion of the surface of at least one of the golf club and the golf ball.

2. The apparatus according to claim 1, wherein the temperature pattern is imparted by cooling portions of the golf club and golf ball.

3. The apparatus according to claim 1, wherein the time period necessary to impart the temperature pattern is between about 5 seconds and about 30 seconds.

4. The apparatus according to claim 1, wherein the time period necessary to impart the temperature pattern is about 1 minute or less.

5. The apparatus according to claim 1, wherein the cooling device is operable to lower the temperature of portions of the golf club and golf ball by between about 10° F. and about 30° F.

6. The apparatus according to claim 1, wherein the cooling device is operable to lower the temperature of portions of the golf club and golf ball by about 20° F.

7. The apparatus according to claim 1, wherein the cooling device comprises a plurality of protrusions that are operable to rest flush with the surface of at least one of the golf club and golf ball.

8. The apparatus according to claim 1, wherein the cooling device is operable to impart the temperature pattern to the surface of at least one of the golf club and golf ball in about 30 seconds or less.

9. The apparatus of claim 1, wherein the cooling device further comprises a coolant operable to cool at least a portion of at least two prongs.

10. The apparatus of claim 1, wherein the temperature of the cooled pattern is between about 0° F. and about 50° F.

11. An apparatus for determining the flight characteristics of a golf ball, comprising:

a thermal device;

a thermal imaging device operable to detect and acquire images of a temperature pattern; and wherein the thermal device comprises a cooling device comprising two or more elements operable to impart a temperature pattern to a portion of the surface of the golf ball by contacting a portion of the surface of the golf ball for a predetermined period of time; and wherein the images of the temperature pattern may be analyzed to determine the kinematic characteristics of the golf ball.

12. The apparatus according to claim 11, further comprising a processor operable to analyze the images of the temperature pattern.

13. The apparatus according to claim 11, wherein the difference between the temperature pattern and other portions of the golf ball is between about 10° F. and about 30° F.

14. The apparatus according to claim 11, wherein the difference between the temperature pattern and other portions of the golf ball is about 20° F.

15. The apparatus according to claim 11, wherein the thermal device comprises a focused emitting device.

16. A method of determining the flight characteristics of a golf ball, comprising:

imparting a temperature pattern to localized portions of the surface of a golf ball by contacting the surface of the golf ball; and detecting the temperature pattern based on a thermal detection device;

wherein the difference between the temperature pattern and other portions of the surface of the golf ball is between about 10° F. and about 30° F.; and wherein the temperature pattern is imparted by using one or more elements to actively impart a thermal pattern by cooling the portion of the surface of the golf ball.

17. The method according to claim 16, wherein the difference between the temperature pattern and other portions of the surface of the golf ball is about 20° F.

18. The method according to claim 16, wherein the difference between the temperature pattern and other portions of the surface of the golf ball is about 30° F.

19. The method according to claim 16, further comprising:

acquiring images of the temperature pattern; and processing the images to determine the kinematic characteristics of the golf ball.

20. The method according to claim 19, wherein the kinematic characteristics include at least one of side spin, back spin, trajectory, and velocity.

21. The method according to claim 16, wherein the temperature pattern is imparted in about 1 minute or less.

22. The method according to claim 16, wherein the temperature pattern is imparted in between about 5 seconds and 30 seconds.

* * * * *